US005652568A

United States Patent [19]

Ko

[11] Patent Number: 5,652,568

[45] Date of Patent: Jul. 29, 1997

[54] WALL OUTLET ALARM AND CHIME

[76] Inventor: Joseph Y. Ko, 12 Morning Dove, Laguna Niguel, Calif. 92677

[21] Appl. No.: 570,037

[22] Filed: Dec. 11, 1995

[51] Int. Cl.[6] ..... G08B 13/19

[52] U.S. Cl. ..... 340/567; 340/528; 340/541; 340/693

[58] Field of Search ..... 340/567, 541, 340/693, 528

[56] References Cited

U.S. PATENT DOCUMENTS

| | | | |
|---|---|---|---|
| 3,320,601 | 5/1967 | Yankus | 340/693 |
| 3,745,550 | 7/1973 | Anthony et al. | 340/528 |
| 4,510,488 | 4/1985 | St. Jean et al. | 340/567 |
| 5,015,994 | 5/1991 | Hoberman et al. | 340/567 |
| 5,128,654 | 7/1992 | Griffin et al. | 340/567 |

*Primary Examiner*—Glen Swann

*Attorney, Agent, or Firm*—Knobbe, Martens, Olson & Bear LLP

[57] ABSTRACT

A security device providing alarm and chime units is an inexpensive and unobtrusive system which the typical homeowner can easily install and operate. The device includes a housing having a front plate which replaces the standard residential wall outlet plate. A motion detecting sensor, a chime unit, an alarm unit capable of at least 110 decibels, and a converter to convert the alternating current to direct current are also included in the housing. A switch is provided on the housing for setting the device from OFF to ALARM or CHIME, as desired. The present invention mounts at standard electrical wall outlets and uses the available alternating current (AC) to power the device, thus eliminating the worry of a possibly discharged power source.

11 Claims, 2 Drawing Sheets

WALL OUTLET ALARM AND CHIME

BACKGROUND OF THE INVENTION

The present invention relates to security devices, and, in particular, to a wall-mounted alarm unit.

Today's society, particularly in primarily urban regions, is very security conscious. Security systems are present in every business facility, and most people have alarm units in their cars and their homes. Some home security systems are quite complex and expensive to install and operate. Usually, these security systems are designed to prevent entry into a building through a door or window. Unauthorized entry activates an alarm which may be audible to the intruder and/or relayed to security personnel. However, most experienced thieves are familiar with the various types of systems, their locations in the home and their operation.

Many families rely on simple door and window locks to prevent access into their homes. This approach is often felt to be a cost-effective method of securing their homes. However, again, most thieves can usually readily bypass these devices because they are usually predictably positioned at the doors and windows and have no redundant or backup alarms.

SUMMARY OF THE INVENTION

The wall outlet AC alarm and chime device of the present invention provides an inexpensive and unobtrusive alarm device which the typical homeowner can easily install and operate. Since there are a plurality of electrical wall outlets available in the typical home, which may or may not be readily visible, the present device can surprise even a very experienced thief or intruder. The use of the alternating current (AC) available at the wall outlets to power the present device eliminates the worry of a discharged power source.

In a preferred embodiment, a ball-type passive infrared (PIR) sensor is located at a front plate of a housing which is semipermanently mounted to an AC electrical outlet. A switch is set to one of three possible positions: "CHIME", "OFF" or "ALARM". Preferably, an alarm of about 115–120 decibels (db) or a chime of about 95 db is emitted after a delay period. The chime option allows the device to be used a less urgent indicator of someone's presence, rather than an emergency security alert provided by the alarm option. A first delay period is provided to allow exit from the secured area by the user after activation, and a second delay period is provided to allow deactivation of the device by the user. It is preferred that a slidable cover be positioned over the switch to prevent accidental switching of the device and further to make the device appear to be fairly innocuous and less obviously an alarm device.

The device of the present invention provides an affordable alarm and chime unit which can be used alone or as a redundant system to an existing system at home or work. Further advantages and applications will become apparent to those skilled in the art from the following detailed description and the drawings referenced herein.

DETAILED DESCRIPTION OF THE PREFERRED EMBODIMENT

Figure 1:
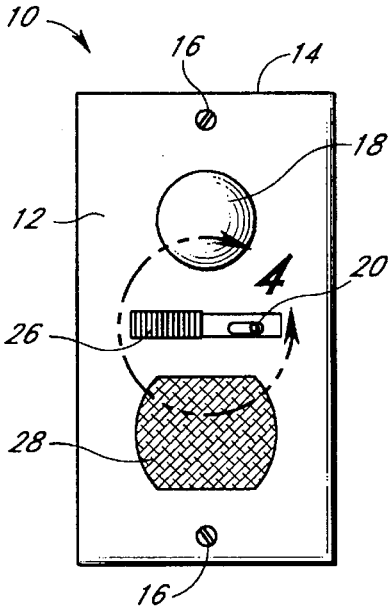
FIG. 1 is a front elevational view of a preferred embodiment of the alarm and chime device of the present invention.

A preferred embodiment 10 of the alarm and chime device of the present invention is shown in FIG. 1. A housing 12 of the device 10 includes a front plate portion 14 which is attached to a typical 110 Volt AC electrical wall outlet, in place of a conventional wall plate (not shown). Preferably, screws 16 which mounted the original wall plate are used to mount the housing 12 at corresponding locations on the front plate portion 14. The outer dimensions of the front plate portion 14 are approximately the same as the standard wall plate found in homes and businesses; thus, the device 10 of the present invention may be utilized in almost every room of every home and business having an electrical outlet.

Figure 4:
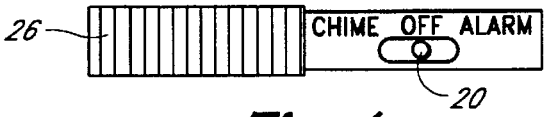
FIG. 4 is a detail view of the switch of the preferred embodiment of the alarm and chime device.

Preferably, a passive infrared (PIR) sensor 18 is adapted to be mounted on the front plate portion 14 of the device housing 12, such that it is directed outwardly to an area or room for which the device 10 is used to provide security. A switch 20 is provided on the front plate portion 14 for setting of the device operation to one of three preferred options: "CHIME", "OFF" or "ALARM", shown in FIG. 4. In ALARM mode, an alarm unit 22 emits an alarm sound upon an activation sequence described below, and, similarly, in CHIME mode a chime unit 24 emits a chime sound. Preferably, a slidable cover 26 is positionable over the switch 20 to prevent accidental switching of the device 10 and further to make the device 10 appear to be fairly innocuous to outsiders and less obviously an alarm unit.

As shown in FIG. 1, a speaker portion 28 is provided on the front plate portion 14 to direct the alarm or chime sounds toward the secured area. Although the PIR sensor 18, switch 20 and speaker portion 28 are shown in descending order on the front plate portion 14, it is understood that other arrangements of the sensor 18, switch 20 and speaker portion 28 are possible with the present invention, as understood by those of ordinary skill in the art. Also, the switch 20 may exclude the chime option in an alternate embodiment.

Figure 2:
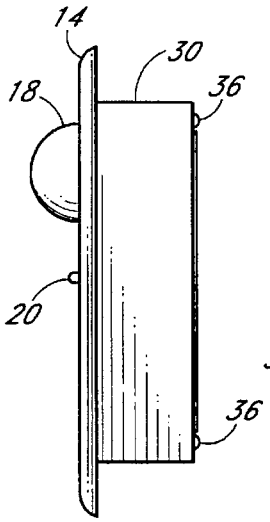
FIG. 2 is a side elevational view of the preferred embodiment of the alarm and chime device.

It can be seen in FIG. 2 that a ball-type PIR sensor 18 is preferably used with the present invention. However, other types of PIR sensors, such as flat and/or square shaped, may alternatively be used. Also, other types of motion-detecting sensors which are known to those skilled in the art may be used with the present invention. Generally, a PIR sensor detects lower frequency light having wavelengths greater than that of visible light, or wavelengths on the order of approximately 1 millimeter (mm) versus 0.0004–0.0007 mm for visible light. A warm body, either human or animal, is detected by the sensor, while a desk or bed would not be detected. In the device 10 of the present invention, the sensor 18 may be of any compact construction known to those skilled in the art having a detection range of about 12–15 feet.

Figure 3:
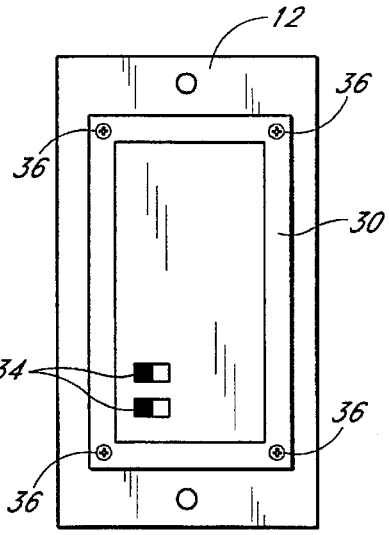
FIG. 3 is a rear elevational view of the preferred embodiment of the alarm and chime device.

FIG. 2 also shows a body 30 of the housing 12 which extends distally into the wall surrounding the electrical outlet and which contains the circuitry for the PIR sensor 18, the switch 20, the alarm and chime units 22, 24 and the speaker portion 28, as well as an AC/DC converter 32 of the device 10. A typical double outlet has two two- or three-pronged outlet covers (not shown). For installation of the present invention, the two outlet covers are removed in addition to the removal of the wall plate. Two wires (not shown) for each outlet are thereby exposed, and these are attached to the rear of the housing body 30, as indicated in FIG. 3. Preferably, the wires are attached by the use of push-in or direct snap insert terminals 34 well known to those skilled in the art. A conventional ground contact is also established in connecting the power source for the device 10. The housing body 30 may be attached to the front plate portion 14, using four screws 36 as shown. Other shapes of the housing body may alternatively be used instead of the rectangular shape shown in FIGS. 2 and 3, as well as other attachment methods thereof.

Figure 6:
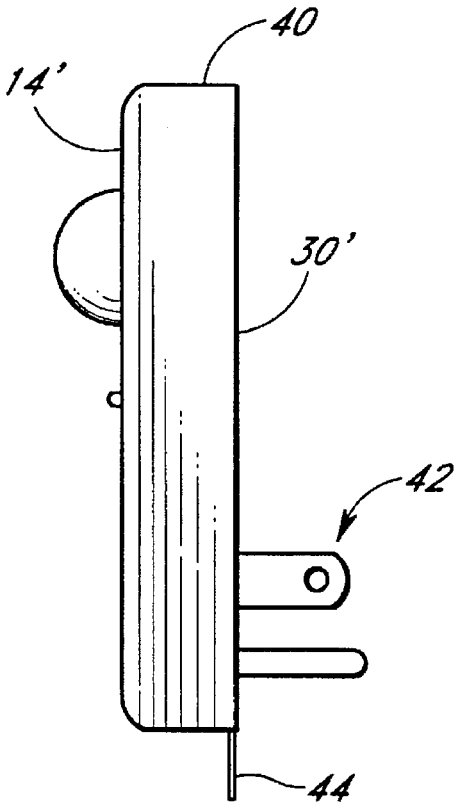
FIG. 6 is a side elevational view of another preferred embodiment of the alarm and chime device of the present invention.
Figure 7:
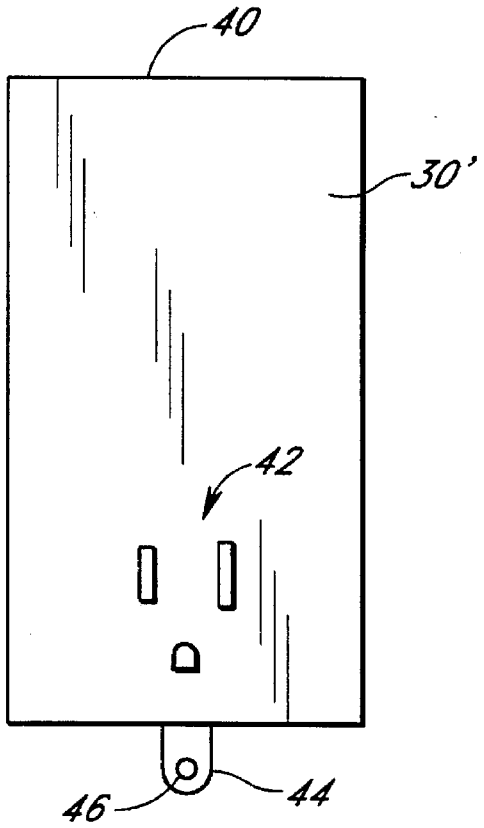
FIG. 7 is a rear elevational view of the embodiment of FIG. 6.

An alternative embodiment of the present invention, shown in FIGS. 6 and 7, utilizes the existing wall outlet, without modification, and provides a direct plug-in capability. A housing body 40 comprises a front portion 14' and a rear portion 30'. The front portion 14' is very similar to the embodiment of FIG. 1, while the rear portion 30' includes three prongs 42 for direct, electrical connection to the AC power. Preferably, the front portion 14' includes a safety tab 44 which has a hole 46 to receive the screw 16 of the original plate, or a slightly longer screw (not shown), to fasten the device to the wall plate and thereby prevent removal of the device by a child. Thus, this embodiment is an easily installable and removable embodiment of the present invention and includes the other elements of the first embodiment as previously described herein.

Figure 5:
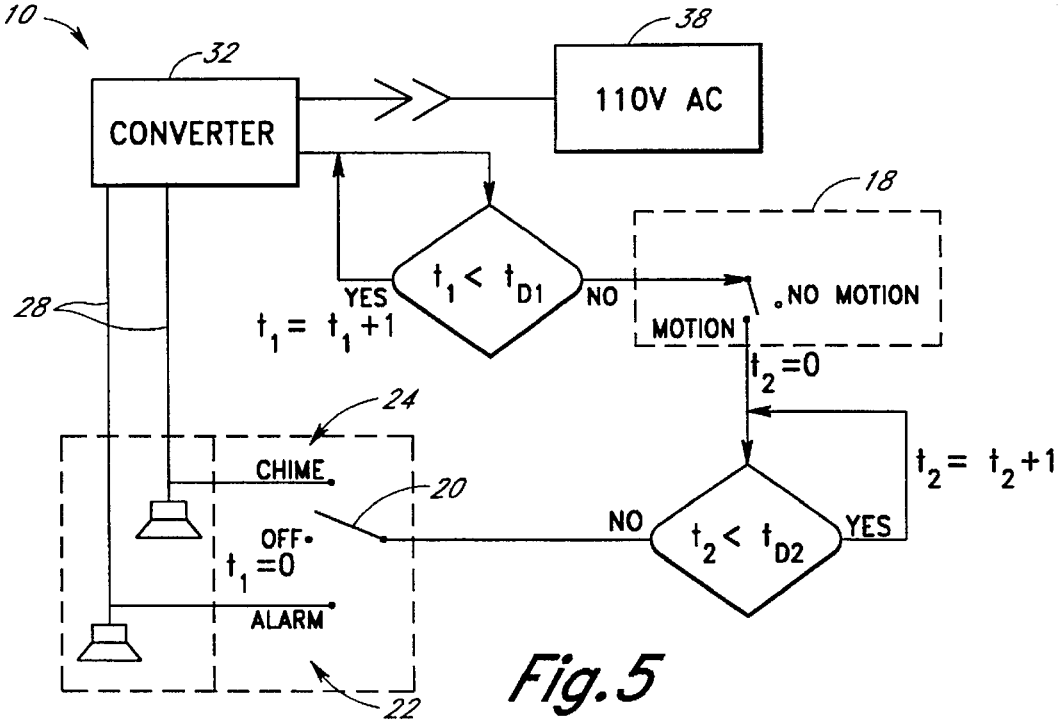
FIG. 5 is a simplified schematic of the preferred embodiment of the alarm and chime device of the present invention.

Referring now to the simplified schematic of FIG. 5, the general operation of the preferred embodiments of the alarm and chime device 10 of the present invention is represented. The 110 V AC power source 38 is connected to the conventional converter 32, which provides direct current (DC) electrical power to the alarm and chime units 22, 24. In the event of electrical power loss, the setting (CHIME/OFF/ALARM) of the device 10 is unchanged and timers or simple counters $t_1$, $t_2$ are reset. However, a deliberate sabotage of electrical power by a potential intruder is not likely, since the sabotage would probably only be performed in a home expected to have an electric security system, and not in the homes most likely to use the device 10 of the present invention.

It is preferred that a first delay period $t_{D1}$ of about 30 seconds is provided to allow exit from the secured area by the user after activation of the device 10. It is also preferred that a second delay period $t_{D2}$ of about 10 seconds is provided to allow deactivation of the device 10 by the user. The length of these delay periods $t_{D1}$, $t_{D2}$ may vary in alternate embodiments.

The alarm unit 22 includes a siren alarm of about 115–120 decibels (db) in volume, provided by a piezoelectric buzzer or the like (not shown). The chime unit 24 includes a chime of about 95 db in volume, and may be a computer circuit or chip having a ding-dong sound effect or the like. The alarm and chime units 22, 24 are preferably selectively connected to the speaker portion 28 via the switch 20. The alarm sound is preferably at least 60 seconds in duration, and the chime sound may comprise three cycles of 5 seconds each. The alarm or chime unit 22, 24 is preferably reset about 5–10 seconds after emission of the sound(s).

The chime option allows the device 10 to be used as an entry/exit indicator without a full security alert. That is, parents may use this setting to indicate the movements of their children, or a business may use this setting to indicate the presence of a customer.

Thus, the wall outlet AC alarm and chime device 10 of the present invention provides an inexpensive and unobtrusive alarm device which the typical homeowner can easily install and operate. Since there are a plurality of electrical wall outlets available in the typical home, which may or may not be readily visible, the present device 10 can surprise even an experienced thief or intruder. The use of the alternating current (AC) electricity available at the wall outlets to power the present device eliminates the worry of a discharged power source such as a battery. The present invention also provides a cost-effective backup or redundant alarm to existing locks and/or alarms and is suitable for home or office use.

The embodiments illustrated and described above are provided merely as examples of the wall outlet AC alarm and chime device of the present invention. Other changes and modifications can be made from the embodiments presented herein by those skilled in the art without departure from the spirit and scope of the invention, as defined by the appended claims.

What is claimed is:

1. A semipermanent alarm device utilizing an AC electrical power source at a wall outlet, said alarm device comprising:

a wall mounted housing, said housing having a front plate portion for replacing a standard wall plate of said outlet;

a motion-detecting sensor adapted to be mounted at said front plate portion of said housing;

an alarm unit having a speaker portion mounted at said front plate portion of said housing for emitting an alarm sound of at least 110 decibels; a converter for converting said AC power source to DC power for said sensor and said alarm unit, said converter located within said housing and operatively connected to wires of said AC power source located in the wall at said outlet;

a switch for electrically coupling said DC power to said alarm unit when set by a user to an ALARM position from an OFF position; and a chime unit, said switch electrically coupling said DC power to said chime unit when set by a user to a CHIME position, said chime unit emitting a chime sound of about 95 decibels.

2. The alarm device of claim 1, wherein said sensor comprises a passive infrared sensor.

3. The alarm device of claim 1, wherein said housing has a sliding cover over said switch.

4. The alarm device of claim 1, further comprising a delay timer for activating said device after a first predetermined time from the setting of said switch from said OFF position to allow exit from the area of said device, said delay timer waiting a second predetermined time from a positive motion detection by said sensor to allow deactivation of said device prior to emission of said alarm sound.

5. The alarm device of claim 1, further comprising a plug portion provided at a rear of said housing such that said converter is operatively connected to said wires of said AC power source via two or more male connectors.

6. The alarm device of claim 1, further comprising a safety tab for preventing removal of said device.

7. A semipermanent alarm device utilizing an AC electrical power source at a wall outlet, said alarm device comprising:

a wall mounted housing, said housing having a front plate portion for replacing a standard wall plate of said outlet;

a motion-detecting sensor adapted to be mounted at said front plate portion of said housing;

an alarm unit having a speaker portion mounted at said front plate portion of said housing for emitting an alarm sound of at least 110 decibels;

a converter for converting said AC power source to DC power for said sensor and said alarm unit, said converter located within said housing and operatively connected to wires of said AC power source located in the wall at said outlet;

a switch for electrically coupling said DC power to said alarm unit when set by a user to an ALARM position from an OFF position; and a sliding cover over said switch.

8. The alarm device of claim 7, wherein said sensor comprises a passive infrared sensor.

9. The alarm device of claim 7, further comprising a delay timer for activating said device after a first predetermined time from the setting of said switch from said OFF position to allow exit from the area of said device, said delay timer waiting a second predetermined time from a positive motion detection by said sensor to allow deactivation of said device prior to emission of said alarm sound.

10. The alarm device of claim 7, further comprising a plug portion provided at a rear of said housing such that said converter is operatively connected to said wires of said AC power source via two or more male connectors.

11. The alarm device of claim 7, further comprising a safety tab for preventing removal of said device.

* * * * *